United States Patent [19]

Takahata et al.

[11] 4,150,986

[45] Apr. 24, 1979

[54] DOPED $TiO_2$ ELECTROPHOTOGRAPHIC PHOTOSENSITIVE MATERIALS

[75] Inventors: Kei Takahata; Hajime Murakami, both of Kusatsu, Japan

[73] Assignee: Ishihara Sangyo Kaisha, Ltd., Osaka, Japan

[21] Appl. No.: 724,216

[22] Filed: Sep. 17, 1976

[51] Int. Cl.[2] ..... G03G 5/087; G03G 5/09

[52] U.S. Cl. ..... 96/1.5 R; 252/501

[58] Field of Search ..... 96/1.5, 1.8; 252/501

[56] References Cited

U.S. PATENT DOCUMENTS

| | | | |
|---|---|---|---|
| 2,331,444 | 10/1943 | Wainer | 96/1.5 |
| 2,800,559 | 7/1957 | Ubbelohde | 96/1.5 UX |
| 2,894,159 | 7/1959 | Sheldon | 252/501 X |
| 2,955,938 | 10/1960 | Steinhilper | 96/1.5 |
| 3,121,006 | 2/1964 | Middleton et al. | 96/1.5 |
| 3,197,307 | 7/1965 | Blake et al. | 96/1.8 |
| 3,632,527 | 1/1972 | Alpert et al. | 96/1.5 X |
| 3,698,894 | 10/1972 | Foss | 96/1.8 X |
| 3,736,134 | 5/1973 | Gosselink et al. | 96/1.8 |
| 3,864,127 | 2/1975 | Miyatuka | 96/1.8 |
| 3,976,485 | 8/1976 | Groner | 96/1 PE X |

FOREIGN PATENT DOCUMENTS

| | | | |
|---|---|---|---|
| 46-32719 | 9/1971 | Japan | 96/1.5 |

OTHER PUBLICATIONS

Schaffert, *Electrophotography*, 1975, pp. 142–143, 323–325, 333–334, 345–350 and 372–373.

Bube, *Photoconductivity of Solids*, 1960, pp. 158–162.

Dessauer et al., *Xerography and Related Processes*, 1965, pp. 133–134.

Gould, *Inorganic Reactions and Structure*, 1965, pp. 90–95.

Cotton et al., *Advanced Inorganic Chemistry*, 1967, pp. 33–34 and 100–104.

Jida and Nozaki, "Influence of Impurity Doping on Photoconductivity of $TiO_2$ (Rutile)", *Kogyo Kagaku Zasshi*, vol. 70, No. 8, 1967, pp. 1285–1287.

*Primary Examiner*—Roland E. Martin, Jr.

*Attorney, Agent, or Firm*—Cushman, Darby & Cushman

[57] ABSTRACT

Electrophotographic photosensitive materials having excellent electrophotographic properties and high whiteness wherein titanium dioxide containing a small amount of Li, Zn, Mg, Ca or Ba in its crystal structure is used as electrophotographic photosensitive powder.

15 Claims, No Drawings

DOPED $TiO_2$ ELECTROPHOTOGRAPHIC PHOTOSENSITIVE MATERIALS

The present invention relates to photosensitive materials used in so-called electrophotographic method, which comprises charging the surface of a photosensitive material uniformly by corona charge, decaying the charge of the exposed area by light image exposure to form an electrostatic latent image, and then depositing a charged colored toner on the electrostatic latent image to form a visible image on the photosensitive material, said photosensitive material containing improved titanium dioxide as photosensitive powder.

The properties in relation to the behavior of charge of a photosensitive material as required in charge and exposure steps up to the formation of an electrostatic latent image in electrophotographic method are called "electrophotographic properties of the photosensitive material" en bloc. Specifically, the electrophotographic properties include charge acceptance, charge maintenance in the dark, light decay, etc. The charge acceptance means change in the surface potential of a photosensitive material with the lapse of time after charging operation was commenced. The charge maintenance in the dark means change in the surface potential of a photosensitive material with the lapse of time after charging operation was suspended and maintenance in the dark was commenced. The light decay means change in the surface potential of a photosensitive material with the lapse of time after the start of light exposure. As the other properties, there are mentioned pre-exposure effect which shows the degree of affection to the above-mentioned three properties by exposing before the start of charging operation and chromatic sensitivity which shows the wave length range and distribution of an irradiating light for which photosensitivity is shown and shows a relation between light sensitivity and wave length. Said charge acceptance is desirably such one as a high potential is obtained in a short period of time. The charge maintenance in the dark is desirably such one as the surface potential after charging operation is maintained for a long period of time without decaying in the dark. Also, the light decay is desirably such one as the surface potential decays rapidly according to exposure.

Electrophotographic photosensitive materials containing a conductive substrate and an electrophotographic photosensitive layer positioned thereon and comprising photosensitive powder and a non-conductive resin binder have heretofore been known. As the photosensitive powder, there have been known powders of zinc oxide, selenium, cadmium sulfide, etc.

It is known that titanium dioxide has also properties as such photosensitive powder. As compared with the above-mentioned photosensitive powders, however, titanium dioxide is faulty in basic electrophotographic properties although it has several excellent properties. Therefore, titanium dioxide has not yet been put to practical use as photosensitive powder. Thus, such a photosensitive material using titanium dioxide is inferior particularly in charge maintenance in the dark than a photosensitive material using zinc oxide which is at present put to practical use widely, and has a defect in that its electrophotographic properties such as charge acceptance, charge maintenance in the dark and light decay are remarkably affected by the kind of the resin binder used and thereby the kinds of the resin binder utilizable are limited. The largest reason why the photosensitive material using titanium dioxide has not yet been put to practical use is the fact that such a resin is limited to a small number of kinds as can give excellent charge maintenance in the dark as a binder which is mixed with titanium dioxide to yield a photosensitive layer.

In order to obviate these defects of titanium dioxide, for example, a process which comprises mixing titanium dioxide with zinc oxide, a process which comprises using special titanium dioxide obtained from an organo titanium compound, and a process which comprises mixing titanium dioxide with specific non-conductive resin binders have been proposed in Japanese Patent Kokoku (Post-Exam. Publn.) Nos. 5,469/74, 11,595/74, 32,350/74, 36,768/75 and 40,016/75. However, no satisfactory results have been obtained even by these processes. Also, it is reported in Kogyo Kagaku Zasshi, Vol. 70, No. 8, Page 1285 (1967) that, in order to improve the light sensitivity of titanium dioxide, titanium dioxide was calcined at 1000° C. in the presence of nitrates of various metals for 2 hours to add an impurity to titanium dioxide positively and the photo current and dark current of these products were measured. As a result, Pb, Ca and Mg improved the light sensitivity slightly, but Zn and Li rather reduced the light sensitivity.

The present inventors examined the electrophotographic properties of a photosensitive layer obtained by coating a conductive substrate with a dispersion of titanium dioxide in a resin binder, rather than the photo current of titanium dioxide itself. As a result, it was found that the abovementioned photo current and dark current of titanium dioxide itself did not necessarily correspond with electrophotographic properties such as light decay and charge maintenance in the dark of the photosensitive layer. Also, it was found that the electrophotographic properties, and particularly charge maintenance in the dark, of photosensitive layers comprising a resin binder and titanium dioxide containing several impurities some of which were estimated in said report to be unable to improve the light sensitivity of titanium dioxide were superior to those of prior art photosensitive layers using titanium dioxide.

An object of the present invention is to improve the electrophotographic properties of titanium dioxide to such a degree as it can be put to practical use as photosensitive powder for electrophotography. Another object of the invention is to provide photosensitive titanium dioxide powder which can be used for many resins without restricting the kinds of the resin binder. A further object of the invention is to obtain practical electrophotographic photosensitive materials by using as photosensitive powder titanium dioxide obtained from prior art steps of the production of titanium for pigment such as sulfate process or chloride process without using highly pure titanium dioxide produced by a special process. A still further object of the invention is to provide electrophotographic photosensitive materials having excellent electrophotographic properties and high whiteness.

According to the present invention, there are provided electrophotographic photosensitive materials comprising a conductive substrate and an electrophotographic photosensitive layer positioned thereon and used in electrophotographic method which comprises charging the electrophotographic photosensitive layer followed by exposing and developing, characterized in that said photosensitive layer consists mainly of powdery titanium dioxide and a non-conductive resin binder and said titanium dioxide contains 0.001 to 5% by mole of at least one element selected from the group consisting of Li, Zn, Mg, Ca and Ba based on the amount of $TiO_2$ in its crystal structure.

As a process for producing titanium dioxide, there are, for example, a process which comprises calcining hydrated titanium dioxide obtained by thermal hydrolysis of an acidic aqueous solution of titanium such as an aqueous titanium tetrachloride solution or an aqueous titanium sulfate solution, a process which comprises subjecting titanium tetrachloride to oxidative decomposition with an oxygen-containing gas, and a process which comprises calcining ammonium titanyl sulfate. The titanium dioxide used in the present invention may be one produced by any one of these processes, but 0.001 to 5% by mole of said metals based on the amount of $TiO_2$ are added into its crystal structure by treating with the metal compounds as described below at least in the calcining step.

As the calcining step, there are mentioned the step of calcining hydrated titanium dioxide, the step of calcining ammonium titanyl sulfate, and the step of re-calcining crystalline or amorphous titanium dioxide. When titanium dioxide obtained by vapor phase oxidative decomposition of titanium tetrachloride is treated, a calcining step is additionally carried out. The titanium dioxide used in the present invention preferably does not contain compounds other than the metal compounds as described above as far as possible. For example, compounds of Fe, Mn, Ni, Co, V, Cr, P, Al and Si have remarkable undesirable effects on the electrophotographic properties. Therefore, it is preferable that these compounds are not contained in the titanium dioxide as far as possible. However, it is not necessary that the titanium dioxide has a ultrahigh purity. Also, compounds of Na, K and B have no bad effect so long as the amount thereof is small although their preferable effect can not be expected. Therefore, these compounds may be contained in an amount harmless to the electrophotographic properties for the other objects, for example, for the control of particle form and particle size as pigments. In general, the crystal forms of titanium dioxide are of rutile type and of anatase type, but any one of these crystal forms of titanium dioxide may be used in the present invention. The particle size of the titanium dioxide used in the present invention is usually 0.1 to 10 $\mu$, and preferably 0.2 to 2 $\mu$.

As a compound containing lithium, zinc, magnesium, calcium, and barium used in the step of growing titanium dioxide crystals, oxides, hydroxides, halides, nitrates, sulfates and organic acid salts of these metals may be used, and the compounds may be used alone or as a mixture of two or more thereof. The amount of these compounds added varies according to the specific metal and can not be prescribed generally, but is usually 0.001 to 5% by mole, and preferably 0.01 to 5% by mole, as a metal element based on the amount of $TiO_2$. Particularly, when the metal is lithium, the amount is preferably 0.02 to 0.1% by mole as Li based on the amount of $TiO_2$. When the metal is other than lithium, the amount is preferably 0.1 to 5% by mole as the metal element based on the amount of $TiO_2$. If the amount is less than 0.001% by mole, the desired effects can not be obtained. Also, if the amount is more than 5% by mole, the properties of titanium dioxide are lost and the other undesirable effects are produced. Of the above-mentioned metals, zinc shows a remarkable effect in an improvement in charge maintenance in the dark as compared with the other metals. The reason therefor is not clear but is considered to be the fact that zinc is a sole transition metal among the above-mentioned metals and is excellent in thermal diffusion for titanium dioxide.

In order to add said metals into the crystal structure of titanium dioxide, the calcining step is carried out in the presence of the metal compounds. In this case, the metal compounds may be added before calcining or on calcining according to their kind and physical properties. Calcining is usually carried out at 700° to 980° C., and preferably at 700° to 850° C., for 0.1 to 3 hours, and preferably 1 to 2 hours. If the temperature is lower than 700° C., charge maintenance in the dark can not be improved. Also, if the temperature is higher than 980° C., light decay becomes poor. If a lower temperature falling within the above-mentioned calcining temperature range is employed, calcining for a long period of time is required. If a higher temperature is employed, the desired effects can be obtained by calcining for a short period of time.

When the thus improved titanium dioxide is mixed with a non-conductive resin binder and a photosensitive layer is formed therefrom, charge maintenance in the dark is remarkably improved, a wide range of the resins can be used without limiting the kind of the resins used, and satisfactory electrophotographic properties are shown. Also, the photosensitive materials of the present invention have continuous tone of images and high whiteness as compared with prior art zinc oxide photosensitive materials. In practical use, however, treating agents for improving electrophotographic properties used in prior art electrophotographic photosensitive materials must be often used. Another improvement in the present invention is to improve further the electrophotographic properties by adsorbing strongly a dye photosensitizer, an agent for improving charge maintenance in the dark, a pre-exposure effect inhibitor or a charge acceptance improver, which are known as treating agents for improving electrophotographic properties, onto the surface of the above-mentioned improved titanium dioxide particles. If the improved titanium dioxde is mixed with said treating agents and the mixture is heated at a temperature of 90° to 250° C., and preferably 120° to 200° C., the treating agents are strongly adsorbed onto the surface of titanium dioxide particles and the electrophotographic properties of the photosensitive layer is remarkably improved.

It is not necessary for the above-mentioned treating agents to be able to improve all the electrophotographic properties by the use of one of the treating agents. If a treating agent can improve at least one of the electrophotographic properties, it is possible to obtain a balanced improvement in the whole electrophotograhic properties by the use of a suitable combination of such treating agents. Specifically, so-called dye photosensitizers which may improve chromatic sensitivity are exemplified by coloring matters of anthraquinone, phthalein, xanthene, cyanine, triphenylmethane, azoic, azine and oxazine types. Examples of the agent for improving charge maintenance in the dark include amines, organic acids, silane conpling agents, resins, metal salts of organic acids and alcohols having 7 or more carbon atoms. Examples of the pre-exposure effect inhibitor include said coloring matters, phenols and amines. Also, examples of the charge acceptance improver include metal salts of organic acids, organic acids, phenols, amines, silane conpling agents, resins and alcohols having 7 or more carbon atoms.

As described above, charge maintenance in the dark can be remarkably improved by incorporating said metals into the crystal structure of titanium dioxide. If the above-mentioned treating agents known as an agent for improving charge maintenance in the dark such as, for example, metal salts of organic acids, amines and alcohols are strongly adsorbed onto the surface of the thus improved titanium dioxide particles, light decay can also be remarkably improved. It is a surprising fact.

Also, when titanium dioxide produced by sulfate process is used as photosensitive powder, electrophotographic properties are slightly poor and reduction in charge maintenance in the dark is easy to occur if the photosensitive layer is exposed to air at a comparatively high humidity. In this case, it is of a great commercial practical value to improve electrophotographic properties by adsorbing metal salts of organic acids, amines and alcohols having 7 or more carbon atoms strongly onto the surface of titanium dioxide particles. The salts of organic acids may be those as obtained by a combination of an organic acid such as naphthenic acid, octenoic acid, octylic acid, 2-ethylhexylic acid, stearic acid, dimethylcarbamic acid, salicyclic acid, undecylenic acid, lactic acid, ethylenediaminetetraacetic acid, phthalic acid, maleic acid or fumaric acid with a metal such as zinc, calcium, cobalt, manganese, copper, zirconium, tin, aluminum and iron. The amount of said metal salts adsorbed nto titanium dioxide is, for example, usually 0.05 to 1% by mole, and preferably 0.1 to 0.5% by mole, as a metal element based on the amount of $TiO_2$ when the metals are zinc, calcium and tin. Also, when the metals are cobalt, copper, iron and manganese, the amount is usually 0.0001 to 0.1% by mole, and preferably 0.01 to 0.05% by mole. The amines are exemplified by diethylenetriamine, diphenylamine, tert-octylamine, dipropylenetraiamine and o-phenylenediamine. also, the alcohols having 7 or more carbon atoms are exemplified by n-octyl alcohol, benzyl alcohol, stearyl alcohol and lauryl alcohol. These compounds are usually adsorbed in an amount of 0.01 to 2% by mole. Among the above-mentioned treating agents, metal salts of organic acids are easy to use from the viewpoint of practicability.

The thus treated titanium dioxide is dispersed in a resin binder according to a conventional process to form a photosensitive layer. This photosensitive layer is positioned onto a conductive substrate and, if necessary, dried to form a photosensitive material. Since titanium dioxide obtained according to the present inventio is not restricted with regard to the kind of the resin binder, a wide range of resin binders can be used so long as they have film forming property and excellent electric insulation. Examples of the resin binder include acrylic resins, alkyd resins, polyester resins, vinyl resins, polyurethane resins, various natural resins, synthetic rubbers, amino resins and polyolefin resins. They may be used alone or as a mixture of two or more thereof according to object. Particularly, the present invention permits the use of acrylic resins and vinyl resins which have heretofore been unusable in spite of the fact that they are excellent in transparency, stability and less pre-exposure effect. The photosensitive layer contains 30 to 60% by volume, and usually 40 to 50% by volume, of titanium dioxide. The conductive substrate may be any one having a higher conductivity than that of the photosensitive layer. Any conductive substrate used generally in electrophotography may be used. For example, paper and fabric coated with a conductive material such as a quaternary ammonium salt, a metal sheet, a plastic sheet coated with a metal by vacuum evaporation and paper laminated with a metal foil may be widely used.

The photosensitive materials of the present invention thus obtained show a remarkable improvement in electrophotographic properties, and particulary in charge maintenance in the dark, which has been considered to be the largest defect of a $TiO_2$ photosensitive layer, as compared with prior art $TiO_2$ photosensitive layers. Also, the photosensitive materials of the present invention have advantages, as compared with photosensitive materials using zinc oxide, in that an image having excellent continuous tone can be obtained and positive and negative charges can be retained.

The following examples illustrate the present invention.

EXAMPLE 1

Preparation of Titanium Dioxide (A) An aqueous titanium sulfate solution obtained by dissolving a titanium ore in sulfuric acid is subjected to thermal hydrolysis to precipitate hydrated titanium dioxide. The precipitate is filtered, washed, dried and then pulverized to obtain hydrated titanium dioxide powder. To the hydrated titanium dioxide is added 1% by mole as Zn of an aqueous zinc acetate solution based on the amount of $TiO_2$. The mixture is calcined in an electric oven at 800° C. for 2 hours and then pulverized to obtain improved titanium dioxide having a particle size of about 0.5 $\mu$.

(A') Titanium dioxide for control is obtained in the same manner as in (A) except that addition of zinc acetate on calcination is omitted.

(B) Improved titanium dioxide is obtained in the same manne as in (A) except that the aqueous titanium sulfate solution is replaced by an aqueous titanium tetrachloride solution.

(B') Titanium dioxide for control is obtained in the same manner as in (B) except that addition of zinc acetate on calcination is omitted.

(C) Titanium dioxide powder is obtained in the same manner as in (A) except that addition of 1% by mole as Zn of zinc acetate on calcination is replaced by addition of 0.5% by mole as Ca of calcium acetate on calcination. Further, 0.2% by mole as Zn of a benzene solution of zinc n-octylate (as a treating agent for improving electrophotographic properties) based on the amount of $TiO_2$ is added. The mixture is stirred, dried up and then heated at 200° C. for 1 hour to obtain improved titanium dioxide.

(C') Titanium dioxide for control is obtained in the same manner as in (C) except that addition of calcium acetate on calcination is omitted and zinc n-octylate is replaced by zinc naphthenate.

(D) Improved titanium dioxide is obtained in the same manner as in (C) except that addition of 0.5% by mole as Ca of calcium acetate on calcination is replaced by addition of 0.25 by mole as Li of lithium acetate on calcination.

(E) Improved titanium dioxide is obtained in the same manner as in (A) except that addition of 1% by mole as Zn of zinc acetate on calcination is replaced by addition of 0.2% by mole as Mg of magnesium acetate on calcination and the calcination temperature is 850° C., (F) Improved titanium dioxide is obtained in the same manner as in (E) except that addition of 0.2% by mole as Mg of magnesium acetate on calcination is replaced by addition of 0.5% by mole as Mg of magnesium acetate and 0.5% by mole as Ca of calcium acetate on calcination.

(G) Improved titanium dioxide is obtained in the same manner as in (E) except that addition of 0.2% by mole as Mg of magnesium acetate on calcination is replaced by addition of 0.2% by mole as Zn of zinc acetate and 0.5% by mole as Ca of calcium acetate on calcination.

Preparation of Electrophotographic Photosensitive Materials and Measurement of Electrophotographic Properties (A)-(D) Into a glass bottle are charged 8 g of said titanium dioxides, about 30 g of glass beads (as a pulverization medium), 4 g of an acrylic resin (trademark, Acrydic A-405, supplied by Jaan Reichhold Chemicals, Inc.), 0.008 g as Zn of zinc naphthenate (as a treating agent for improving electrophotographic properties) and 4 ml of xylene (as a solvent). The mixture is shaken by a 5110 Red Devil paint conditioner for 5 minutes to form a paste and then the paste is coated onto an aluminum foil by a wire applicator. The coating is dried by heating at 120° C. for 30 minutes and the coated aluminum foil is allowed to stand in the dark for 2 days to obtain photosensitive materials according to the present invention. The thickness of the dry coating film is about 17 $\mu$.

The electrophotographic properties of the thus obtained photosensitive materials are measured by a paper analyzer model SP-428 manufactured by Kawaguchi Denki. This measurement is carried out by drawing an electrophotographic characteristic curve by said apparatus according to dynamic and static methods, respectively. Charge acceptance is expressed as the surface potential (initial potential) which is reached in 20 seconds by corona charge according to dynamic method. Charge maintenance in the dark is expressed as the percentage of the surface potential as shown 20 seconds after charge for 20 seconds according to dynamic method to the initial potential. Light decay is expressed as a half-valued period for light decay of surface potential when a pre-exposure potential is 200 volts according to static method. A loaded voltage in corona charge is −6 kV and an exposure illumination is 300 luxes.

(E)-(G) The same operations as described above are carried out except that Metalac M Clear (trademark, Fujikura Kasei Co., Ltd.) is used as the acrylic resin and zinc naphthenate is replaced by 0.004 g each of uranine, Rhodamine B and Brilliant Cresyl Blue (as dye photosensitizers).

The results obtained are as shown in Table 1.

Table 1

| Photosensitive material | Element present on calcination (% by mole) | Initial potential (volts) | Charge maintenance in the dark (%) | Light decay half-valued period (seconds) |
|---|---|---|---|---|
| A | Zn : 1 | 320 | 68 | 3.2 |
| B | Zn : 1 | 320 | 78 | 1.2 |
| C | Ca : 0.5 | 270 | 42 | 1.4 |
| D | Li : 0.2 | 142 | 44 | 3.5 |
| E | Mg : 0.2 | 590 | 48 | 0.9 |
| F | Mg : 0.5<br>Ca : 0.5 | 720 | 42 | 0.9 |
| G | Zn : 0.2<br>Ca : 0.5 | 510 | 51 | 0.9 |
| A' | None | 29 | 10 | Unable to measure |
| B' | " | 540 | 28 | 6.0 |
| C' | " | 70 | 18 | 4.7 |

EXAMPLE 2

A photosensitive material (H) is prepared in the same manner as in (B) of Example 1 except that 0.5% by mole as Zn of zinc oxide based on the amount of $TiO_2$ is added in place of zinc acetate on calcination of hydrated titanium dioxide and a styrene-modified alkyd resin (trademark Styresol 4440, supplied by Japan Reichhold Chemicals, Inc.) is used as a resin binder for the photosensitive material. A photosensitive material (H') for control is prepared in the same manner except that addition of zinc oxide on calcination is omitted. Electrophotographic properties are measured in the same manner as in Example 1. The results obtained are as shown in Table 2.

Table 2

| Photosensitive material | Element present on calcination (% by mole) | Initial potential (volts) | Charge maintenance in the dark (%) | Light decay half-valued period (seconds) |
|---|---|---|---|---|
| H | Zn : 0.5 | 980 | 80 | 1.6 |
| H' | — | 300 | 62 | 1.4 |

EXAMPLE 3

To 10 g of highly pure titanium dioxide obtained by subjecting titanium tetrachloride to oxidative decomposition in a vapor phase is added an amount of an aqueous solution of zinc nitrate ($Zn(NO_3)_2$) corresponding to 0.3% by mole as Zn based on the amount of $TiO_2$. The mixture is well stirred, dried, calcined at 800° C. in an electric oven for 2 hours, and then pulverized to obtain improved titanium dioxide having a particle size of about 1$\mu$. A photosenstive material is prepared from the improved titanium dioxide and its electrophotographic properties are measured in the same manner as in (A) of Example 1. As a result, it is found that initial potential is 450 volts, charge maintenance in the dark is 82% light decay half-valued period is 2.5 seconds. Thus, the product is a photosensitive material excellent in electrophotographic properties.

EXAMPLE 4

(J - 1) The improved titanium dioxide (A) of Example 1 (1% by mole of Zn added on calcination) is entered into a solution of zinc naphthenate in benzene to deposit zinc naphthenate onto the surface of titanium dioxide particles. The thus treated titanium dioxide particles are filtered, dried and then subjected to heat treatment at 200° C. for 30 minutes. Thus, titanium dioxide containing 0.1% by mole as Zn of zinc naphthenate based on the amount of $TiO_2$ strongly adsorbed thereonto is obtained. A photosensitive material is prepared from this titanium dioxide and its electrophotographic properties are measured in the same manner as in (A) of Example 1 (except that the pre-exposure potential for measurement of light decay is 250 volts).

(J - 2) The same operations as in (J-1) are carried out except that the zinc naphthenate treatment is omitted.

(J - 3) The same operations as in (J-1) are carried out except that zinc is not added on calcination of titanium dioxide.

(J - 4) The same operations as in (J-1) are carried out except that neither addition of zinc on calcination nor the zinc naphthenate treatment is carried out.

The results obtained are as shown in Table 3.

Table 3

| Photo sensitive material | Zinc present on calcination (% by mole) | Zinc naphthenate treatment (Zn % by mole) | Initial potential (volts) | Charge maintenance in the dark (%) | Light decay half-valued period (sec.) |
|---|---|---|---|---|---|
| J - 1 | 1 | 0.1 | 540 | 91 | 1.1 |
| J - 2 | 1 | — | 320 | 68 | 4.1 |
| J - 3 | — | 0.1 | 260 | 61 | 4.3 |
| J - 4 | — | — | 250 | 0 | — |

EXAMPLE 5

The hydrated titanium dioxide obtained by subjecting an aqueous titanium tetrachloride solution to thermal hydrolysis is calcined in the presence of 1% by mole as Zn of zinc acetate based on the amount of $TiO_2$ at 800° C. for 2 hours and then pulverized. The pulverized product is dispersed in Isopar H (an isoparaffin solvent supplied by Esso Co.) or decalin (as a solvent). A treating agent for improving electrophotographic properties is directly added to the dispersion or is dispersed in a solvent and then added to the dispersion. The mixture is heated to the boiling point of Isopar H or decalin to effect surface treatment. Thus, improved titanium dioxide containing said treating agent strongly adsorbed thereonto is obtained.

Into a glass bottle are charged 8 g of the thus obtained titanium dioxide, about 30 g of galss beads (diameter 1.5 to 2.5 mm), 3.4 g of a resin binder and 5 ml of xylene. The mixture is shaken by a 5110 Red Devil paint conditioner for 5 minutes to form a paste. The resulting paste is coated onto an aluminum foil by a wire applicator, dried at 120° C. for 30 minutes and then stored in the dark for 2 days to obtain photosensitive materials.

The charge acceptance, charge maintenance in the dark and light decay of the thus obtained photosensitive materials are measured by said paper analyzer. As for pre-exposure effect, an irradiation from a tungsten lamp at an illuminance of 3000 luxes is carried out for 4 seconds. After 30 seconds charge acceptance, charge maintenance in the dark and light decay are measured by the paper analyzer. The pre-exposure effect is estimated by changes in each property as compared with the case where no pre-exposure is given. Chromatic sensitivity is estimated by producing the spectrogram of each photosensitive material by a grating spectrograph GR-1 manufactured by Narumi Shokai. The results obtained are as shown in Table 4. The photosensitive materials of the present invention have remarkably been improved in all electrophotographic properties as compared with photosensitive materials using non-treated titanium dioxide. In Table 4, a particularly remarkable improvement is expressed by ◎, a large improvement by ○, and a slight improvement by Δ as compared with the photosensitive materials prepared by using improved titanium dioxide containing said metals and adding merely said treating agent for improving electrophotographic properties when the improved titanium dioxide is ground together with a resin binder. Also, the amount of the treating agents in the table is expressed in terms of % by weight based on the weight of $TiO_2$. Additives in photosensitive materials Nos. 22 to 52 are added on the preparation of a paste. Mixed coloring matters among them and their amounts are as follows:

Mixed coloring matter 1:

A 1:1:1 mixture of uranin, Rhodamine B and Brilliant Cresyl Blue is used. They are added respectively in an amount of 0.005% by weight based on the weight of $TiO_2$.

Mixed coloring matter 2:

A 1:1:1 mixture of uranin, NK-1870, NK-1410 and Cresyl Violet is used. They are added respectively in an amount of 0.01% by weight based on the weight of $TiO_2$.

Mixed coloring matter 3:

Uranine and Rhodamine B are added respectively in an amount of 0.005% by weight based on the weight of $TiO_2$.

Table 4

| Photo sensitive material | Treating agent for improving electrophotographic properties | Amount of treating agent (% by wt.) | Solvent for dispersing $TiO_2$ | Solvent for treating agent | Heating conditions | Resin binder | Additive | Charge acceptance | Charge maintenance in the dark | Light decay | Pre-exposure effect inhibition | Chromatic sensitivity | C.I. No. of coloring matter |
|---|---|---|---|---|---|---|---|---|---|---|---|---|---|
| | Coloring matters: | | | | | | | | | | | | |
| 1 | Alizarin | 1.92 | Isopar H | Methanol | Boiling point 3 hours | Aroset* 5804RB | | | Δ | | ○ | | 58000 |
| 2 | Quinalizarin | 1.09 | " | " | " | " | | | Δ | | ○ | | 58500 |
| 3 | Uranin | 0.005 | " | " | " | " | | | ○ | ◎ | | ○ | 45350 |
| 4 | Eriochrome Cyanine R | " | " | " | " | " | | | ○ | ◎ | | ○ | 43820 |
| 5 | Eriochrome Black T | " | " | " | " | " | | | ○ | ◎ | | ○ | 14645 |

Table 4-continued

| Photosensitive material | Treating agent for improving electrophotographic properties | Amount of treating agent (% by wt.) | Solvent for dispersing $TiO_2$ | Solvent for treating agent | Heating conditions | Resin binder | Additive | Charge acceptance | Charge maintenance in the dark | Light decay | Pre-exposure effect inhibition | Chromatic sensitivity | C.I. No. of coloring matter |
|---|---|---|---|---|---|---|---|---|---|---|---|---|---|
| 6 | Brilliant Cresyl Blue | " | " | " | " | " | | | Δ | ○ | ○ | ○ | 51010 |
| 7 | Brilliant Cresyl Blue | 0.02 | Isopar H | Methanol | Boiling point 2 hours | Aroset 5804XC | | | ○ | ◎ | ◎ | ○ | 51010 |
| 8 | Fuchsin basic | 0.005 | " | " | " 3 hours | Aroset 5804RB | | | ○ | ◎ | ○ | ○ | 42510 |
| 9 | Rhodamine B | " | " | Water | " | " | | | Δ | ◎ | | ○ | 45170 |
| 10 | Rhodamine 6GO | " | " | Methanol | " | " | | | ○ | ◎ | | ○ | 45160 |
| 11 | Neutral Red | " | " | " | " | " | | | ○ | ◎ | | ○ | 50040 |
| 12 | NK-1837** | " | " | " | " | " | | | ○ | ○ | ○ | Δ | — |
| 13 | NK-79** | " | " | " | " | " | | | ○ | | ○ | | — |
| 14 | NK-85** | " | " | " | " | " | | | ○ | Δ | ○ | Δ | — |
| 15 | Alkali Blue 6B | 0.02 | " | " | " 2 hours | Aroset 5804XC | | | ◎ | ◎ | ○ | ○ | 42750 |
| 16 | Patent Blue A | " | " | " | " | " | | | ◎ | ◎ | Δ | ○ | 42052 |
| 17 | Sky Blue 5B | " | " | " | " | " | | | ◎ | ◎ | | ○ | 24400 |
| 18 | Kiton Blue A | 0.02 | Isopar H | Methanol | Boiling point 2 hours | Aroset 5804XC | | | ◎ | ◎ | Δ | ○ | 42080 |
| 19 | Cotton Blue | " | " | " | " | " | | | ◎ | ◎ | Δ | ○ | 42780 |
| 20 | Neptune Blue BRA | " | " | " | " | " | | | ◎ | ◎ | | ○ | 42090 |
| 21 | Marine Blue V | " | " | " | " | " | | | ◎ | ◎ | Δ | ○ | 42755 |
| | Organic Amines: | | | | | | | | | | | | |
| 22 | Diethylenetriamine | 0.064 | Isopar H | | Boiling point 2 hours | Aroset 5804RB | Mixed coloring matter 1 | ○ | ○ | | | | |
| 23 | Diphenylamine | 0.098 | " | | " | " | " | ○ | Δ | | | | |
| 24 | tert-Octylamine | 0.089 | " | | " | " | " | ○ | Δ | | | | |
| 25 | Dipropylenetriamine | 0.082 | " | | " | " | " | ○ | ○ | Δ | | | |
| 26 | o-Phenylenediamine | 0.068 | Isopar H | | Boiling point 2 hours | Aroset 5804RB | Mixed coloring matter 1 | ○ | ○ | | ◎ | | |
| 27 | " | 0.027 | " | | " | " | " | ○ | ○ | | ○ | | |
| 28 | Aniline | 0.055 | " | | " | " | Mixed coloring matter 2 | ○ | ○ | ○ | | ○ | |
| 29 | Alcohols: n-Octyl alcohol | 1.04 | " | | Boiling point 3 hours | Aroset 5804RB | Mixed coloring matter 1 | ○ | ○ | | | | |
| 30 | Stearyl alcohol | 2.04 | " | | " | " | " | ○ | ○ | | | | |
| 31 | Lauryl alcohol | 1.49 | " | | " | " | " | ○ | ○ | | | | |
| | Organic Acids: | | | | | | | | | | | | |

Table 4-continued

| Photosensitive material | Treating agent for improving electrophotographic properties | Amount of treating agent (% by wt.) | Solvent for dispersing $TiO_2$ | Solvent for treating agent | Heating conditions | Resin binder | Additive | Charge acceptance | Charge maintenance in the dark | Light decay | Pre-exposure effect inhibition | Chromatic sensitivity | C.I. No. of coloring matter |
|---|---|---|---|---|---|---|---|---|---|---|---|---|---|
| 32 | Phthalic anhydride | 0.5 | " | | Boiling point 2 hours | Aroset 5804XC | Mixed coloring matter 1 | ○ | ○ | | | | |
| 33 | Oleic acid | 0.35 | Isopar H | Methanol | Boiling point 2 hours | Aroset 5804XC | Mixed coloring matter 1 | ○ | Δ | Δ | Δ | | |
| 34 | Resins: Hitanol*** 2BO | 5 | " | Decalin | " | Aroset 5804XC | Mixed coloring matter 1 | | ○ | | Δ | | |
| 35 | Hitanol*** 1501 | " | Decalin | " | " | " | " | | ○ | | Δ | | |
| 36 | Styresol**** 4440 | " | " | " | " | " | " | | ○ | | | | |
| 37 | Acrydic A-157 | " | " | " | " | Aroset 5804RB | " | | ○ | Δ | Δ | | |
| 38 | Acrydic A-405 | " | " | " | " | " | " | | ○ | | Δ | | |
| 39 | " A-810 | " | " | " | " | " | " | | ○ | ○ | Δ | | |
| 40 | Silane Coupling Agents: KMB-403***** | 0.005 | Isopar H | | Boiling point 3 hours | Aroset 5804RB | Mixed coloring matter 1 | ○ | ○ | | | | |
| 41 | " | 0.25 | " | | " 2 hours | Aroset 5804XC | " | ○ | ◎ | | | | |
| 42 | KMB-503***** | 0.005 | " | | " 3 hours | Aroset 5804RB | " | ○ | ○ | | | | |
| 43 | " | 0.25 | " | | " 2 hours | Aroset 5804XC | " | ○ | ◎ | | | | |
| 44 | Phenols: Eugenol | 1.31 | " | | " 3 hours | Aroset 5804RB | " | ○ | Δ | | ◎ | Δ | |
| 45 | " | 0.10 | " | | " 2 hours | Aroset 5804XC | " | ○ | ○ | | ◎ | Δ | |
| 46 | Phenol | 0.75 | " | | " 3 hours | Aroset 5804RB | " | ○ | ○ | | ◎ | | |
| 47 | Phenol | 0.059 | Isopar H | | Boiling point 2 hours | Aroset 5804XC | Mixed coloring matter 1 | | ○ | | ◎ | | |
| 48 | p-Cresol | 0.87 | " | | " 3 hours | Aroset 5804RB | " | ○ | Δ | | ◎ | | |
| 49 | Combined Treatment: O-Phenylenediamine Brilliant Cresyl Blue | 0.068 0.02 | Isopar H | Methanol | Boiling point 2 hours | Aroset 5804XC | Mixed coloring matter 3 | | ◎ | ○ | ○ | ○ | |
| 50 | Acrydic A-157 Zinc octylate | 5 0.5 as | Decalin | | " | " | Mixed colorint | ○ | ○ | | | | |

Table 4-continued

| Photosensitive material | Treating agent for improving electrophotographic properties | Amount of treating agent (% by wt.) | Solvent for dispersing $TiO_2$ | Solvent for treating agent | Heating conditions | Resin binder | Additive | Charge acceptance | Charge maintenance in the dark | Light decay | Pre-exposure effect inhibition | Chromatic sensitivity | C.I. No. of coloring matter |
|---|---|---|---|---|---|---|---|---|---|---|---|---|---|
| | | Zn | | | | | matter 1 | | | | | | |
| 51 | Acrydic A-405 Zinc octylate | 5<br>0.5 as Zn | " | | " | " | " | ○ | ○ | | | | |
| 52 | Acrydic A-810 Zinc octylate | 5<br>0.5 as Zn | Decalin | | Boiling point 2 hours | Aroset 5804XC | Mixed coloring matter 1 | ○ | ○ | | | | |

Notes:
*Acrylic resin binder manufactured by Nisshoku Arrow Chemical Co., Ltd.
**Coloring matters manufactured by Japan Research Institute for Photosensitizing Dyes Co., Ltd.
***Alkylphenol resins manufactured by Hitachi Chemical Co., Ltd.
****Styrene-modified alkyd resin manufactured by Dai Nippon Ink & Chemicals Inc.
*****Silane coupling agents manufactured by Shin-etsu Chemical Industry Co., Ltd.

What is claimed is:

1. An electrophotographic photosensitive material comprising an electrically conductive substrate and an electrophotographic photosensitive layer positioned thereon and used in an electrophotographic method which comprises charging the electrophotographic photosensitive layer followed by exposing and developing, characterized in that said photosensitive layer consists essentially of zinc-doped titanium dioxide disposed in an electrically insulating resin binder, said zinc-doped titanium dioxide having been produced by mixing titanium dioxide or hydrated titanium dioxide with a zinc compound in a Ti/Zn molar ratio of 100:0.1 to 100:5 and then calcining the resulting mixture at a temperature of 700°–980° C. for 0.1 to 3 hours.

2. The electrophotographic photosensitive material according to claim 1, wherein said electrically insulating resin binder is an acrylic resin.

3. The electrophotographic photosensitive material according to claim 1, wherein said zinc-doped titanium dioxide is produced from hydrated titanium oxide which has been obtained by thermal hydrolysis of an aqueous titanium tetrachloride solution.

4. The electrophotographic photosensitive material according to claim 1, wherein said zinc-doped titanium dioxide is produced from hydrated titanium dioxide which has been obtained by thermal hydrolysis of an aqueous titanium sulfate solution.

5. The electrophotographic photosensitive material according to claim 1, wherein said zinc-doped titanium dioxide is produced from titanium dioxide which has been obtained by vapor phase oxidative decomposition of titanium tetrachloride.

6. An electrophotographic photosensitive material comprising an electrically conductive substrate and an electrophotographic photosensitive layer positioned thereon and used in an electrophotographic method which comprises charging the electrophotographic photosensitive layer followed by exposing and developing, characterized in that said photosensitive layer consists essentially of zinc-doped titanium dioxide disposed in an electrically insulating resin binder; said zinc-doped titanium dioxide having been produced by mixing titanium dioxide or hydrated titanium dioxide with a zinc compound in a Ti/Zn molar ratio of 100:0.1 to 100:5, calcining the resulting mixture at a temperature of 700°–980° C. for 0.1 to 3 hours, adding to said calcined mixture at least one treating agent for improving electrophotographic properties, and then heating the resulting mixture at a temperature of 90° to 250° C.

7. The electrophotographic photosensitive material according to claim 6, wherein said treating agent for improving electrophotographic properties is selected from dye photosensitizers, amines, alcohols, organic acids, resins, silane coupling agents, phenols and metal salts of organic acids.

8. The electrophotographic photosensitive material according to claim 6, wherein said treating agent is at least one salt of an organic acid selected from the group consisting of naphthenic acid, octenoic acid, octylic acid, 2-ethylhexylic acid, stearic acid, dimethylcarbamic acid, undecylic acid, lactic acid, ethylenediaminetetraacetic acid, phthalic acid, maleic acid and fumaric acid with a metal selected from the group consisting of zinc, calcium, cobalt, manganese, copper, zirconium, tin, aluminum and iron.

9. The electrophotographic photosensitive material according to claim 6, wherein said treating agent for improving electrophotographic properties is at least one alcohol selected from the group consisting of n-octyl alcohol, stearyl alcohol, lauryl alcohol and benzyl alcohol.

10. The electrophotographic photosensitive material according to claim 6, wherein said treating agent for improving electrophotographic properties is at least one amine selected from the group consisting of diethylenetriamine, diphenylamine, tert-octylamine, dipropylenetriamine and o-phenylenediamine.

11. The electrophotographic photosensitive material according to claim 6, wherein said zinc-doped titanium dioxide is produced from hydrated titanium dioxide which has been obtained by thermal hydrolysis of an aqueous titanium tetrachloride solution.

12. The electrophotographic photosensitive material according to claim 6, wherein said zinc-doped titanium dioxide is produced from hydrated titanium dioxide which has been obtained by thermal hydrolysis of an aqueous titanium sulfate solution.

13. The electrophotographic photosensitive material according to claim 6, wherein said zinc-doped titanium dioxide is produced from titanium dioxide which has been obtained by vapor phase oxidative decomposition of titanium tetrachloride.

14. An electrophotographic photosensitive material comprising an electrically conductive substrate and an electrophotographic photosensitive layer positioned thereon and used in an electrophotographic method which comprises charging the electrophotographic photosensitive layer consists essentially of zinc-doped titanium dioxide disposed in an acrylic resin binder; said zinc-doped titanium dioxide having been produced by mixing hydrated titanium dioxide obtained by thermal hydrolysis of an acidic aqueous solution of titanium with a zinc compound in a Ti/Zn molar ratio of 100:0.1 to 100:5, calcining the resulting mixture at a temperature of 700°–980° C. for 0.1 to 3 hours, adding to said calcined mixture a zinc or calcium salt of an organic acid, and then heating the resulting mixture at a temperature of 90° to 250° C.

15. The electrophotographic photosensitive material of claim 14 wherein the heat treatment is at 120° to 200° C.

* * * * *